United States Patent [19]

Koike et al.

[11] Patent Number: 4,819,604

[45] Date of Patent: Apr. 11, 1989

[54] FUEL SUPPLY CONTROL METHOD FOR INTERNAL COMBUSTION ENGINES

[75] Inventors: Yuzuru Koike; Kiyoshi Tsukimura, both of Wako, Japan

[73] Assignee: Honda Giken Kogyo Kabushiki Kaisha, Tokyo, Japan

[21] Appl. No.: 131,225

[22] Filed: Dec. 10, 1987

[30] Foreign Application Priority Data

Dec. 10, 1986 [JP] Japan ..... 61-294284
Dec. 10, 1986 [JP] Japan ..... 61-294285

[51] Int. Cl.[4] ..... F02D 41/34; F02D 41/10
[52] U.S. Cl. ..... 123/492; 123/478
[58] Field of Search ..... 123/478, 299, 300, 492, 123/491, 179 L

[56] References Cited

U.S. PATENT DOCUMENTS

| | | | |
|---|---|---|---|
| 3,868,936 | 3/1975 | Rivere | 123/445 |
| 4,002,152 | 1/1977 | Hoshi | 123/487 X |
| 4,140,088 | 2/1979 | De Vulpillieres | 123/299 |
| 4,235,205 | 11/1980 | Fukui | 123/478 |
| 4,315,491 | 2/1982 | Takeda | 123/478 |
| 4,418,672 | 12/1983 | Muller | 123/478 |
| 4,424,785 | 1/1984 | Ishida | 123/478 |
| 4,546,732 | 10/1985 | Mae | 123/478 |
| 4,612,904 | 9/1986 | Tadokoro et al. | 123/492 |
| 4,614,174 | 9/1986 | Tanigawa | 123/478 |

*Primary Examiner*—Tony M. Argenbright
*Attorney, Agent, or Firm*—Lyon & Lyon

[57] ABSTRACT

A method of controlling the supply of fuel to an internal combustion engine having first and second fuel injection valves arranged in the intake passage downstream and upstream of the throttle valve, respectively, both being upstream of the intake manifold wherein the first and second fuel injection valves are selectively operated to supply fuel to the cylinders in dependence on operating conditions of the engine. Fuel is supplied to a plurality of cylinders of the engine through the first fuel injection valve alone when the engine is operating in a predetermined low load condition. In a middle/high load middle speed region of the engine, a substantially constant minimum required quantity of fuel is supplied through the first fuel injection valve, and simultaneously a quantity of fuel appropriate to the middle/-high load middle speed region is supplied through the second fuel injection valve. In a high load high speed region of the engine, if a time interval of generation of a signal generated at predetermined crank angles of the engine is longer than the fuel injection period of the second fuel injection valve, a quantity of fuel corresponding to a difference therebetween is supplied through the first fuel injection valve and simultaneously a quantity of fuel corresponding to the time interval is supplied through the second fuel injection valve.

9 Claims, 4 Drawing Sheets

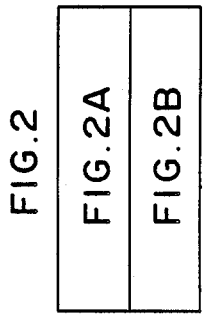
FIG.2
FIG.2A
FIG.2B
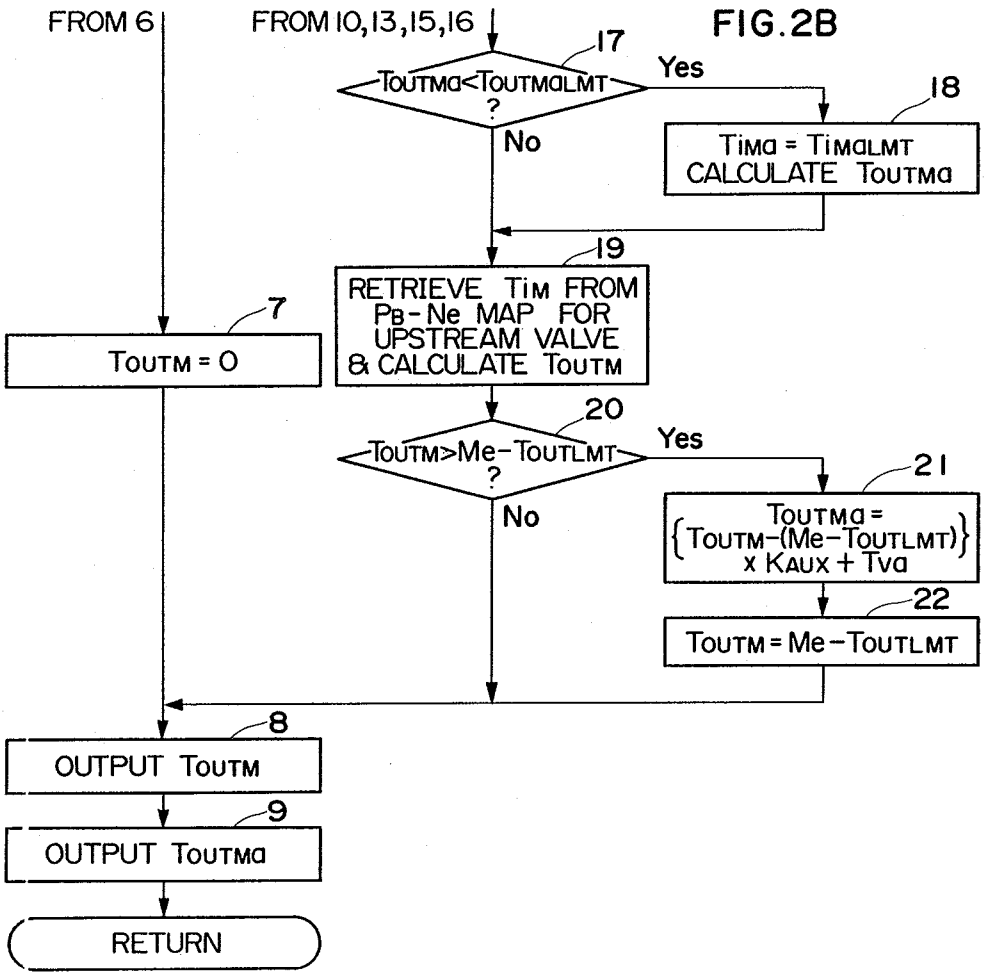
FIG.2B
FROM 6
FROM 10,13,15,16
7
TOUTM = 0
17
TOUTMa<TOUTMaLMT ?
Yes
No
18
TIMa = TIMaLMT
CALCULATE TOUTMa
19
RETRIEVE TIM FROM
PB-Ne MAP FOR
UPSTREAM VALVE
& CALCULATE TOUTM
20
TOUTM>Me-TOUTLMT ?
Yes
No
21
TOUTMa =
{TOUTM-(Me-TOUTLMT)}
x KAUX + TVa
22
TOUTM = Me-TOUTLMT
8
OUTPUT TOUTM
9
OUTPUT TOUTMa
RETURN

FUEL SUPPLY CONTROL METHOD FOR INTERNAL COMBUSTION ENGINES

BACKGROUND OF THE INVENTION

1. Field of the Invention

The present invention relates to a fuel supply control method for internal combustion engines and, more particularly, the present invention relates to a fuel supply control method of controlling fuel supply to a multicylinder internal combustion engine by means of two fuel injection valves provided in an intake pipe upstream and downstream of a throttle valve, respectively.

2. Description of the Prior Art

Japanese Provisional Patent Publication (Kokai) No. 47-35422 discloses a fuel supply control system which controls a single fuel injection valve to supply fuel to the cylinders of a multicylinder internal combustion engine. This known fuel supply control system controls a main fuel injection valve, namely, an ordinary fuel injection valve having a large capacity, disposed upstream of a throttle valve with respect to the direction of flow of intake air during middle load and high load operation of the engine and controls an auxiliary fuel injection valve disposed downstream of the throttle valve with respect to the direction of flow of intake air during low load operation of the engine. A fuel injection valve having excellent fuel atomizing characteristics is employed as the auxiliary fuel injection valve to secure uniform distribution of fuel to all the cylinders during low load operation of the engine.

In such a fuel supply control process, the working fuel injection valve is changed over between the auxiliary fuel injection valve (hereinafter referred to as "downstream valve") and the main fuel injection valve (hereinafter referred to as "upstream valve") when the operating mode of the engine changes from a middle load mode or a high load mode to a low load mode or vice versa. However, when the working injection valve is changed over from the downstream valve to the upstream valve, it occurs that an appropriate amount of fuel which actually contributes to combustion is not surely supplied to the engine at a moment immediately after the changeover of the working injection valve due to the positional difference between the downstream valve and the upstream valve. That is, fuel injected by the downstream valve is supplied directly to the cylinders of the engine only through a portion of the intake pipe extending downstream of the downstream valve, whereas part of the fuel injected by the upstream valve stays temporarily on inner surfaces of the throttle body and surfaces of the throttle valve before flowing into the cylinders of the engine. Consequently, when the operation of the downstream valve is stopped and the operation of the upstream valve is started to supply the same amount of fuel as the downstream valve, an insufficient amount of fuel is supplied temporarily to the engine, adversely affecting the driveabilitry of the engine because fuel injected by the upstream valve at the start of the same stays temporarily on inner surfaces of the throttle body and surfaces of the throttle valve.

Furthermore, the fuel supply amount of fuel supplied to the engine from the upstream valve and the downstream valve is proportional to the fuel injection period for which the injection valve is open. Accordingly, during high load operation of the engine requiring a large fuel supply quantity the fuel injection period has to be increased. However, since the period of suction stroke of the engine diminishes as the engine speed increases, the fuel injection period of the fuel injection valve can be longer than the period of suction stroke of the engine. In such an event, part of the fuel injected by the fuel injection valve provided upstream of the intkae manifold in sychronism with and for a period beyond the period of suction stroke of one cylinder is sucked in the other cylinders. Accordingly, the fuel injection period must not be longer than the period of suction stroke. Under such circumstances, when a large amount of fuel is injected in a short fuel injection period by a fuel injection valve having a large capacity (large nozzle bore), the accuracy of fuel injection control and the atomization of the injected fuel are deteriorated in injecting a small amount of fuel for low load operation of the engine. On the other hand, when a fuel injection valve having a small nozzle bore is used to enable satisfactory atomization of fuel during low load operation of the engine, the maximum fuel flow rate that can acurately be metered is limited to a low level.

SUMMARY OF THE INVENTION

It is, therefore, an object of the invention to provide a fuel supply control method for internal combustion engines, which improves operating characteristics of the engine such as driveability by securing an appropriate fuel supply amount in changing over the working fuel injection valve which supplies fuel according to load on the engine from a fuel injection valve provided upstream of the throttle valve to a fuel injection valve provided downstream of the throttle valve or vice versa.

It is another object of the invention to provide a fuel supply control method for internal combustion engines, which enables satisfactory atomization of fuel during low load operation of the engine and accurate fuel metering control during high-load operation of the engine in supplying fuel by a fuel injection valve provided upstream of the intake manifold.

To attain the above objects, the present invention provides a method of controlling the supply of fuel to an internal combustion engine having a plurality of cylinders, an intake passage having an intake manifold connected to the cylinders, a throttle valve arranged in the intake passage at a location upstream of the intake manifold, at least one first fuel injection valve arranged in the intake passage at a location upstream of the intake manifold, and at least one second fuel injection valve arranged in the intake passage at a location upstream of the intake manifold but axially different from the location of the first fuel injection valve, wherein the first and second fuel injection valves are selectively operated to supply fuel to the cylinders in dependence on operating conditions of the engine, the method comprising the following steps:

(a) determining whether or not the engine is operating in a predetermined low load condition;

(b) supplying fuel to the cylinders through the first fuel injection valve alone, when the engine is determined to be operating in the predetermined low load condition; and (c) supplying fuel to the cylinders through both the first and second fuel injection valves, when the engine is determined to be operating in an operating condition other than the predetermined low load condition.

Preferably, the first fuel injection valve is arranged at a location downstream of the throttle valve, and the second fuel injection valve at a location upstream of the throttle valve, respectively.

In one embodiment of the invention, the operating condition other than the predetermined low load condition of the engine corresponds to a middle/high load middle speed region of the engine, wherein the quantity of fuel supplied by the first fuel injection valve is set to a minimum required valve which is substantially constant, and the quantity of fuel supplied by the second fuel injection valve is set to a value appropriate to the operating condition other than the predetermined low load condition.

Preferably, the quantity of fuel supplied by the first fuel injection valve is progressively decreased, for a limited period of time after the engine has shifted from the predetermined low load condition to the middle/-high load middle speed of the engine, before it is set to the minimum required value.

In another embodiment of the invention, the operating condition other than the predetermined low load condition of the engine corresponds to a high load high speed region of the engine, wherein executed are the steps of determining fuel injection periods of the first and second fuel injection valves on the basis of operating parameters of the engine and in synchronism with a signal generated at predetermined crank angles of the engine, measuring a time interval of generation of the signal when the engine is operating in the operating condition other than the predetermined low load condition, comparing a period of time corresponding to the measured time interval of generation of the signal with the determined fuel injection period of the second fuel injection valve, and when the latter is longer than the former, supplying a quantity of fuel corresponding to a difference between the two periods of time to the cylinders through the first fuel injection valve and at the same time supplying a quantity of fuel corresponding to the measured time interval of generation of the signal to the cylinders through the second fuel injection valve.

Preferably, the period of time corresponding to the time interval of generation of the signal is a difference between the measured time interval of generation of the signal and a period of time required for the second fuel injection valve to become completely shut from an open state thereof.

The above and other objects, features and advantages of the present invention will become apparent from the following description taken in conjunction with the accompanying drawing.

BRIEF DESCRIPTION OF THE DRAWINGS

FIGS. 2, 2A and 2B are a flowchart of a fuel supply control program to be executed by the electronic control unit of the fuel supply control system of FIG. 1;

DETAILED DESCRIPTION

The invention will now be described in detail with reference to the drawings showing an embodiment thereof.

Figure 1:
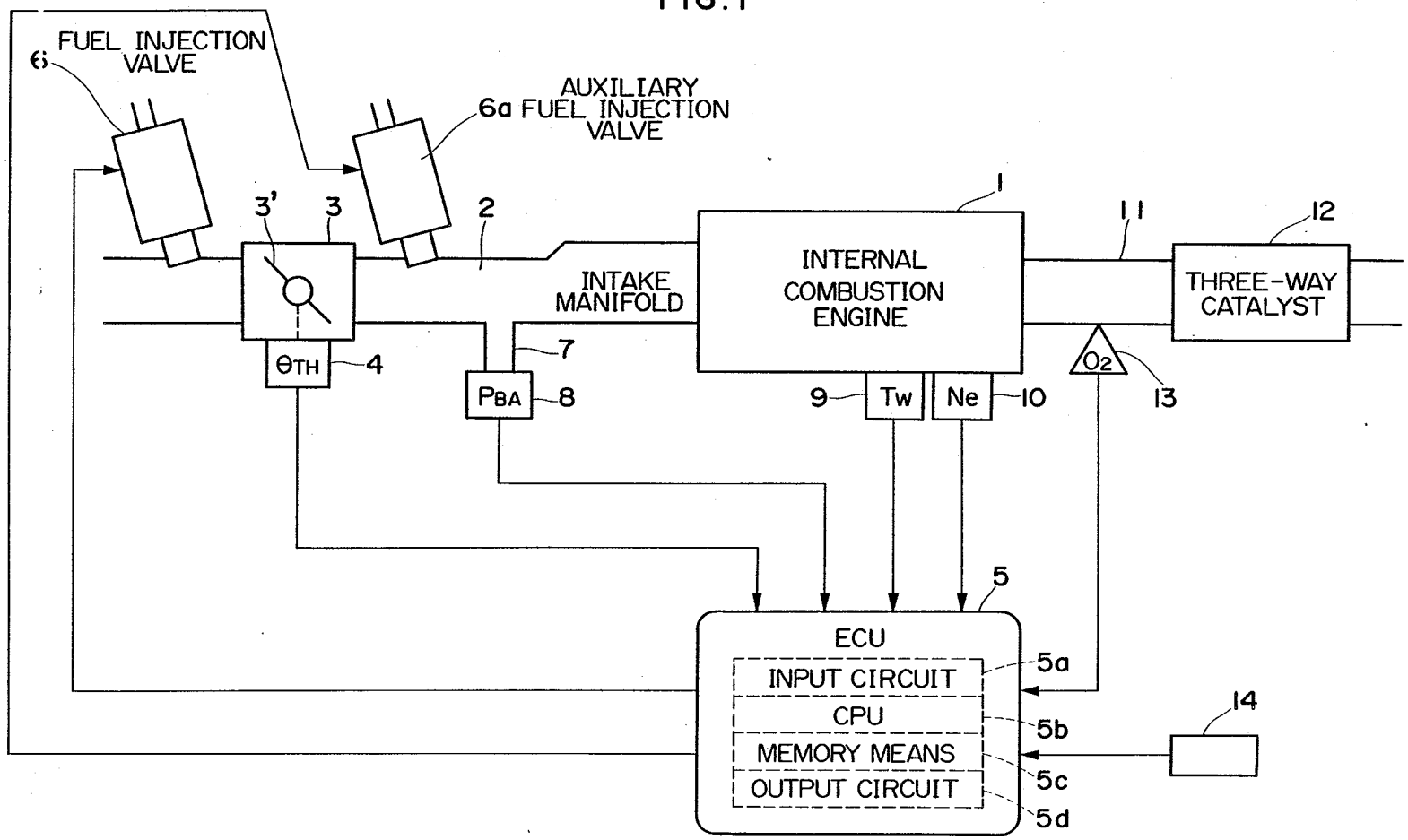
FIG. 1 is a diagrammatic illustration showing the general arrangement of a fuel supply control system for an internal combustion engine, for carrying out the method of the invention.

Referring to FIG. 1, reference numeral 1 designates an internal combustion engine which is four-cylinder four-cycle type (hereinafer referred to simply as "the engine"), for example. An intake pipe 2 is connected through an intake manifold thereof to the engine 1. A throttle body 3 internally provided with a throttle valve 3' is provided in the intake pipe 2. A throttle valve angle sensor 4 for detecting the throttle valve angle $\theta_{TH}$, namely, the degree of opening, of the throttle valve 3' is associated with the throttle valve 3' to give an electric signal representing the degree of opening of the throttle valve 3' to an electronic control unit (hereinafter abbreviated to "the ECU") 5.

A fuel injection valve 6 is provided in the intake pipe 2 at a location slightly upstream of the throttle body 3 to supply fuel to all the cylinders of the engine 1 while the engine 1 is in a high load operation. An auxiliary fuel injection valve **6*a* is provided in the suction pipe 2 at a location upstream of the intake manifold of the intake pipe 2 and slightly downstream of the throttle body 3 to supply fuel to all the cylinders of the engine 1 while the engine is in a low load operation after the same has warmed up. The fuel injection valve 6 and the auxiliary fuel injection valve 6*a* are connected to a fuel pump, not shown, and are electrically connected to the ECU 5. The respective fuel injection periods of the fuel injection valve 6 and the auxiliary fuel injection valve 6*a* are regulated according to signals provided by the ECU 5. A fuel injection valve having excellent fuel atomizing characteristics is employed as the auxiliary fuel injection valve 6*a*** to secure uniform distribution of a small amount of fuel to all the cylinders during the low load operation of the engine.

An absolute pressure sensor 8 for detecting absolute pressure $P_{BA}$ within the intake pipe 2 is connected through a pipe 7 to the interior of the intake pipe 2 at a location downstream of the throttle valve 3' provided in the throttle body 3. The absolute pressure sensor 8 gives an electric signal representing the absolute pressure $P_{BA}$ to the ECU 5.

A cooling water temperature sensor (hereinafter referred to as "the TW sensor") 9 for sensing the temperature of engine cooling water is provided in the cylinder block of the engine 1. The TW sensor 9 comprises a thermistor or the like as a sensing element disposed within the cylinder block of the engine 1 and gives a cooling water temperature signal to the ECU 5. An engine speed sensor (hereinafter referred to as "the Ne sensor") 10 is disposed opposite the cam shaft or crankshaft of the engine 1. The Ne sensor 10 gives a crankshaft angle signal (hereinafter referred to as "the TDC signal") representing a predetermined crankshaft angle before the top dead center of the piston of each cylinder, at which the suction stroke of the cylinder is started, to the ECU 5, whenever the crankshaft rotates through 180°.

The exhaust pipe 11 of the engine 1 is provided with a three-way catalyst unit 12 for purifying noxious components, such as HC, CO and NOx, in exhaust gases. An oxygen sensor 13 is provided in the exhaust pipe 11 at a location upstream of before the three-way catalyst unit 12 to detect the oxygen concentration in the exhaust gases and to give an oxygen concentration signal to the ECU 5.

The ECU 5 comprises an input circuit 5*a* which shapes the respective waveforms of input signals received from some of the sensors, adjusts the respective voltages of input signals from other sensors to a predetermined level and converts the respective analog values of the voltage-adjusted input signals to corresponding digital values, a contral processing unit (hereinafter abbreviated to "the CPU") 5*b*, a memory unit 5*c* which stores programs to be executed by the CPU 5*b* and results of operations executed by the CPU 5*b*, and an output circuit 5*d* which gives driving signals to the fuel injection valve 6 and the auxiliary fuel injection valve 6*a*.

Figure 2A:
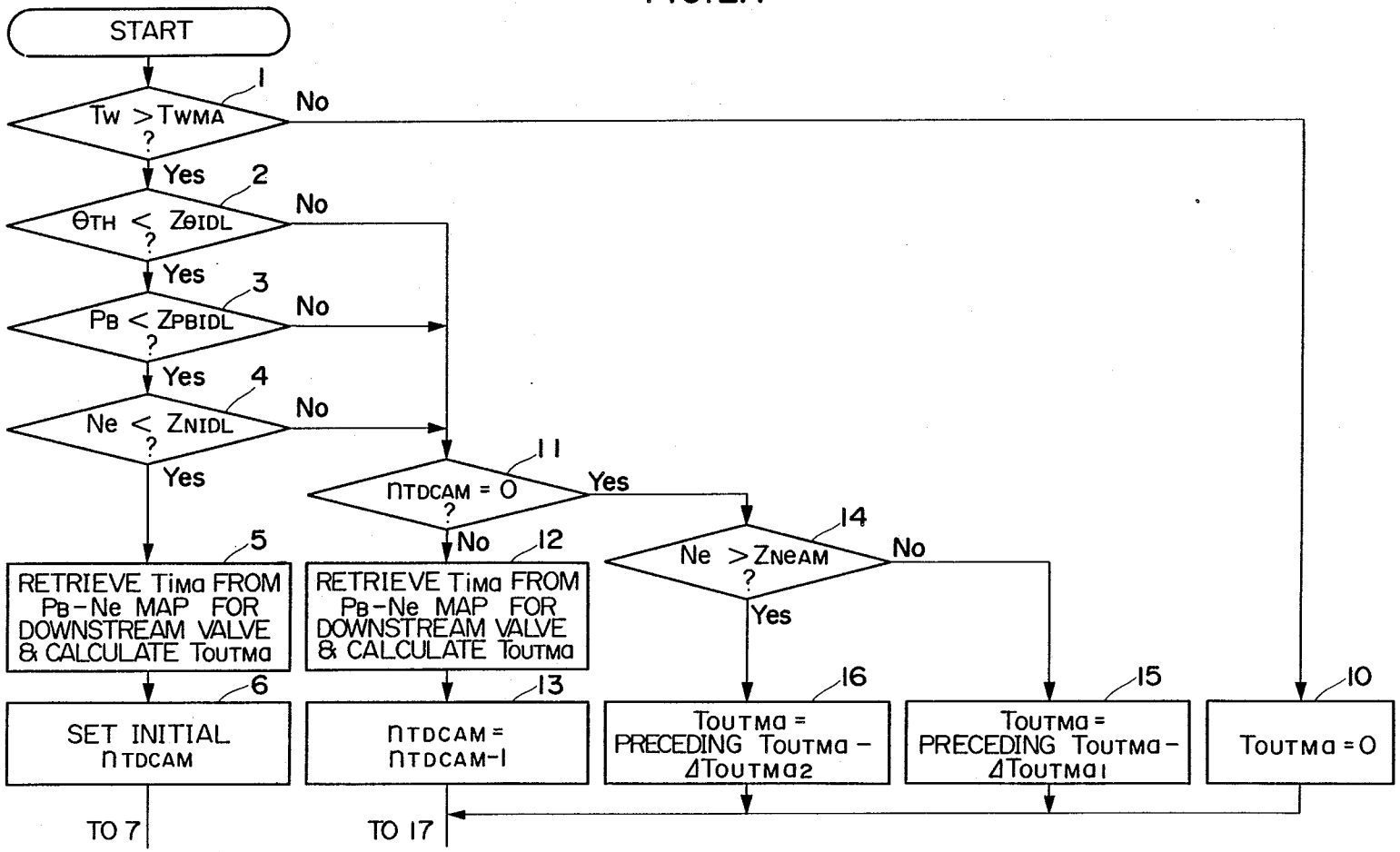

The CPU 5*b* executes a fuel supply control program shown in FIG. 2 whenever it receives a pulse of the TDC signal to calculate the respective fuel injection periods of the fuel injection valve (hereinafter referred to as "the upstream valve") 6 provided upstream of the throttle valve and the auxiliary fuel injection valve (hereinafter referred to as "the downstream valve") 6*a* provided downstream of the throttle valve, on the basis of the output signals of the sensors, namely, engine operating parameter signals, and to give driving signals to the upstream valve 6 and the downstream valve 6*a*, respectively, for driving these valves 6, 6*a* for the calculated fuel injection periods.

The upstream valve 6 and the downstream valve 6*a* are controlled according to operating modes of the engine, namely, an idling mode (hereinafter referred to as "the mode A"), a middle/high load middle speed mode (hereinafter referred to "the mode B") and a high load high speed mode (hereinafter referred to as "the mode C") for optimum fuel supply to the engine so as to operate in manners tabulated below.

valve 6, to calculate an injection period $T_{OUTM}$ of the upstream valve 6 on the basis of the basic injection period $T_{iM}$ (step 19), and to apply an injection valve driving signal corresponding to the calculated injection period $T_{OUTM}$ to the upstream valve 6 in step 8. While the engine 1 is cold, auxiliary air for fast idling is supplied through a throttle bypass, not shown, bypassing the throttle valve, whereby a correspondingly large amount of fuel is required. Therefore, the upstream valve is actuated to supply fuel at an increased fuel injection rate. When a high fuel injection rate is thus required, it is preferable to supply fuel by the fuel injection valve or upstream valve provided at a location remote from the intake manifold to secure satisfactory fuel distribution to a plurality of cylinders.

When the answer to step 1 is "Yes", decisions are made in the following steps 2, 3 and 4 as to whether the engine is operating in the mode A. That is, a decision is made as to whether the throttle valve angle $\theta_{TH}$ is smaller than a predetermined idling throttle valve angle $Z\theta_{IDL}$ (for example, 0.39° in step 2, a decision is made as to whether the absolute pressure $P_B$ in the intake pipe 2 is lower than a predetermined idling absolute pressure $Z_{PBIDL}$ (for example, 350 mmHg) in step 3 and a decision is made as to whether the engine speed Ne is lower than a predetermined idling speed $Z_{NIDL}$ (for example, 1100 rpm) in step 4. When all the answers to steps 2, 3 and 4 are "Yes", that is, when the engine is operating in the mode A, a basic injection period $T_{iMa}$ is retrieved from a $P_B$—Ne map for the downstream valve 6*a*, and then an injection period $T_{OUTMa}$ for the downstream valve 6*a* is calculated on the basis of $T_{iMa}$ by using the following expression (1) in step 5:

$$T_{OUTMa}=T_{iMa}\times K_1+K_2 \quad (1)$$

| Injection valve | Cooling water temperature: Low | Cooling water temperature: High |
|---|---|---|
| **Mode A** | | |
| Downstream | Substantially fixed injection period TOUTMa = TiMaLMT × Ki + K2 | Injection period from MAP TOUTMa = TiMa × Ki + K2 |
| Upstream | Injection period from MAP | Inoperative |
| **Mode B** | | |
| Downstream | Substantially fixed injection period TOUTMa = TiMaLMT × K1 + K2 | |
| Upstream | Injection period from MAP TOUTM = TiM × K1 + K2 | |
| **Mode C** | | |
| Downstream | Substantially fixed injection period TOUTMa = [TOUTM (Me − TOUTLMT)] × KAUX + Tva | |
| Upstream | Maximum injection period TOUTM = Me − TOUTLMT | |

Expressions in the table are used for excuting the fuel supply control program of FIG. 2, which will be described later.

Steps of the fuel supply control program of FIG. 2 will be described hereinafter. The fuel supply control program is started upon generation of each pulse of the TDC signal.

In step 1, a decision is made as to whether the temperature TW of the engine cooling water is higher than a predetermined value $T_{WMA}$ (for example, 20° C.) When the answer to step 1 is "No", namely, when the temperature TW is lower than the predetermined value $T_{WMA}$, the injection period $T_{OUTMa}$ of the downstream valve 6*a* is set temporarily to zero in step 10. Then, step 17 and the following steps are executed to retrieve a basic injection period $T_{iM}$ from $P_B$—Ne map for the upstream where $K_1$ and $K_2$ are correction coefficients and correction variables, respectively, calculated on the basis of engine operating parameters represented by output signals of sensors as aforementioned by using respective predetermined arithmetic expressions so that the engine will operate with optimum operating characteristics such as startability, exhaust emission characteristics, fuel consumption and engine accelerability.

The fuel injection period $T_{OUTMa}$ thus determined corresponds to a fuel quantity required by the engine operating in the mode A.

Then, a control valve $n_{TDCAM}$ (for example, "3") which is used in step 11 is set to an initial value in step 6, and then the injection period $T_{OUTM}$ for the upstream valve 6 is set to "0" in step 7. Accordingly, no driving signal is applied to the upstream valve 6 in executing step 8. Then, an injection valve driving signal corresponding to $T_{OUTMa}$ calculated in step 5 is supplied to the downstream valve 6a in step 9, and then the fuel supply control program is ended. Thus, fuel is supplied by the downstream valve 6a disposed downstream of the throttle valve 3' provided nearer to the cylinders then the upstream valve 6, so that fuel is supplied to the cylinders with high responsiveness to the calculated injection period.

When any one of the answers to steps 2, 3 and 4 is "No", namely, when the engine is operating in the mode B, a decision is made in step 11 as to whether $n_{TDCAM}$ is "0". When the answer to step 11 is "No", step 12, which is similar to step 5, is executed to retrieve $T_{iMa}$ from the $P_B$—Ne map for the downstream valve 6a, and calculate the fuel injection period $T_{OUTMa}$ for the downstream valve 6a on the basis of the retrieved $T_{iMa}$ by using the expression (1). Then, "1" is subtracted from $n_{TDCAM}$ in step 13 and then step 17 and the following steps are executed.

When the answer to step 11 is "Yes", the value $T_{OUTMa}$ obtained in step 12 is reduced by a decrement proportional to the engine speed Ne in steps 14 and 15 or in steps 14 and 16. That is, a decision is made in step 14 as to whether the actual engine speed Ne is higher than a predetermined value $Z_{NeAM}$ (for example, 900 rpm) and, when the answer is "No", a first predetermined value $\Delta T_{OUTMa1}$ (for example, 0.4 msec) as the decrement is subtracted from the preceding value $T_{OUTMa}$ (step 15) or, when "Yes", a second predetermined value $\Delta T_{OUTMa2}$ (for example, 0.2 msec) as the decrement is subtracted from the preceding value $T_{OUTMa}$ (step 16). Then, the routine goes to step 17. The reason for thus applying different decrements depending upon the engine speed Ne is that the amount of fuel adhering to inner surfaces of the throttle body, etc. decreases with the lapse of time, and therefore if the same decrement is applied both at a low engine speed where the TDC signal has a longer pulse separation and at a high engine speed where the TDC signal has a shorter pulse separation, the decreasing rate of $T_{OUTMa}$ is greater at a high engine speed than at a low engine speed so that the fuel amount actually supplied to the cylinders will be insufficient at a high engine speed.

In step 17, a decision is made as to whether $T_{OUTMa}$ calculated in step 12, 15 or 16 is smaller than a lower limit value $T_{OUTMaLMT}$ (for example, 3.0 msec) which is smaller than the minimum value of $T_{OUTMa}$ calculated in step 5 or 12. When the answer to step 17 is "Yes", step 18 is executed to employ the lower limit value $T_{iMaLMT}$ as $T_{iMa}$ and calculate $T_{OUTMa}$ by using the expression (1) ($T_{OUTMa}=T_{iMaLMT}\times K_1+K_2$). And then the routine goes to step 19. When the answer to step 17 is "No", the routine directly goes to step 19. Thus, fuel is supplied by the downstream valve 6a in an amount corresponding to the substantially fixed minimum fuel injection period $T_{OUTMa}(=T_{iMaLMT}\times K_1+K_2)$ after the operating mode of the engine has shifted from the mode A to the mode B. The value of $T_{iMaLMT}$ is the minimum period of time (for example, 1.8 msec) at which fuel can be accurately metered by the downstream valve 6a. Accordingly, while fuel injected by the upstream valve 6 immediately after the operating mode of the engine has shifted from the mode A to the mode B is wetting inner surfaces of the throttle body 3 and surfaces of the throttle valve 3', the downstream valve 6a injects fuel. Therefore, fuel is supplied in a required quantity immediately after changeover of the working fuel injection valve from the downstream valve 6a to the upstream valve 6, so that the variation of air-fuel ratio is suppressed and hence deterioration of the driveability of the engine is prevented. Furthermore, in changing over the working fuel injection valve from the downstream valve 6a to the upstream valve 6, the variation of air-fuel ratio is suppressed to the maximum extent because the fuel injection quantity of the downstream valve 6a is gradually decreased through steps 11, 12, 13, 14 and 15 or through steps 11, 12, 13, 14 and 16. In step 19, the basic fuel injection period $T_{iM}$ is retrieved from the $P_B$—Ne map for the upstream valve 6 and a fuel injection period $T_{OUTM}$ for the upstream valve 6 is calculated on the basis of $T_{iM}$ by using the following expression (2):

$$T_{OUTM}=T_{iM}\times K_1+K_2 \quad (2)$$

where $K_1$ and $K_2$ are the same as those in the expression (1).

The fuel injection period $T_{OUTM}$ thus determined corresponds to a fuel quantity required by the engine operating in the mode B.

In step 20, a decision is made as to whether $T_{OUTM}$ calculated in step 19 is greater than a value Me—$T_{OUTLMT}$, where Me is the interval between adjacent pulses of the TDC signal, which corresponds to the duration of the suction stroke in a four-cylinder four-cycle internal combustion engine, and $T_{OUTLMT}$ is a period of time required for the upstream valve 6 injecting fuel to become completely shut from an open state. When the answer to step 20 is "Yes", the fuel injection period for the downstream valve 6a is calculated in step 21 by using the following expression (3):

$$T_{OUTMa}=[T_{OUTM}-(Me-T_{OUTLMT})]\times K_{AUX}+T_{va} \quad (3)$$

where $K_{AUX}$ is the ratio of the fuel injection rate of the downstream valve 6a to that of the upstream valve 6, and $T_{va}$ is a correction value for compensating for variation of the output voltage of the battery. The downstream valve 6a supplies fuel for the fuel injection period $T_{OUTMa}$ calculated by using the expression (3) to supplement the amount of fuel required in the mode C, which the upstream valve 6 alone is unable to supply within the fuel injection period $T_{OUTM}$ calculated in step 19. Thus, fuel is injected in required quantities even in the mode C. Therefore, the upstream valve 6 need not be of a large capacity (nozzle bore) and hence the upstream valve 6 having a moderate capacity is able to atomize a small amount of fuel satisfactorily for the low load operation of the engine.

Figure 4:
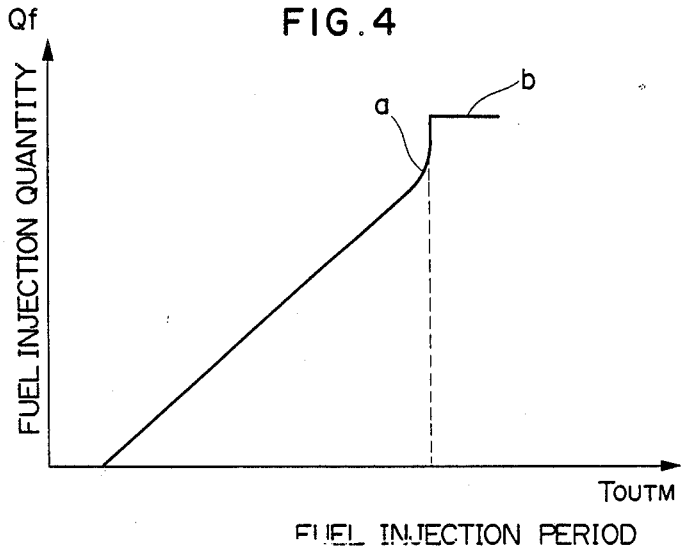
FIG. 4 is a graph showing a fuel injection characteristic of a fuel injection valve.

In step 22, the fuel injection period for the upstream valve 6 is calculated by using the following expression (4):

$$T_{OUTM}=Me-T_{OUTLMT} \quad (4)$$

where Me and $T_{OUTLMT}$ are the same as those in the expression (3). Thus, the upper limit of the fuel injection period for the upstream valve 6 is Me—$T_{OUTM}$. The upstream valve 6 completely shuts in a fuel injection cycle for each cylinder and is never continuously open, which prevents the operation of the upstream valve in a $T_{OUTM}$ range where the fuel injection quantity Qf does not vary in proportion to the fuel injection period $T_{OUT}$ as shown in FIG. 4 when the upstream valve 6 operates in an intermittent high-rate fuel injection mode a or in a continuous fuel injection mode b in the figure.

After step 22 has been executed, the routine goes to step 8. When the answer to step 20 is "No", the upstream valve 6 alone is able to supply all the required fuel quantity, and hence the routine skips over steps 21 and 22 to step 8.

Thereafter, an injection valve driving signal corresponding to the calculated injection period $T_{OUTM}$ is applied to the upstream valve 6 in step 8, an injection valve driving signal corresponding to the calculated injection period $T_{OUTMa}$ is applied to the downstream valve 6a in step 9, and then the fuel supply control program is ended.

Figure 3:
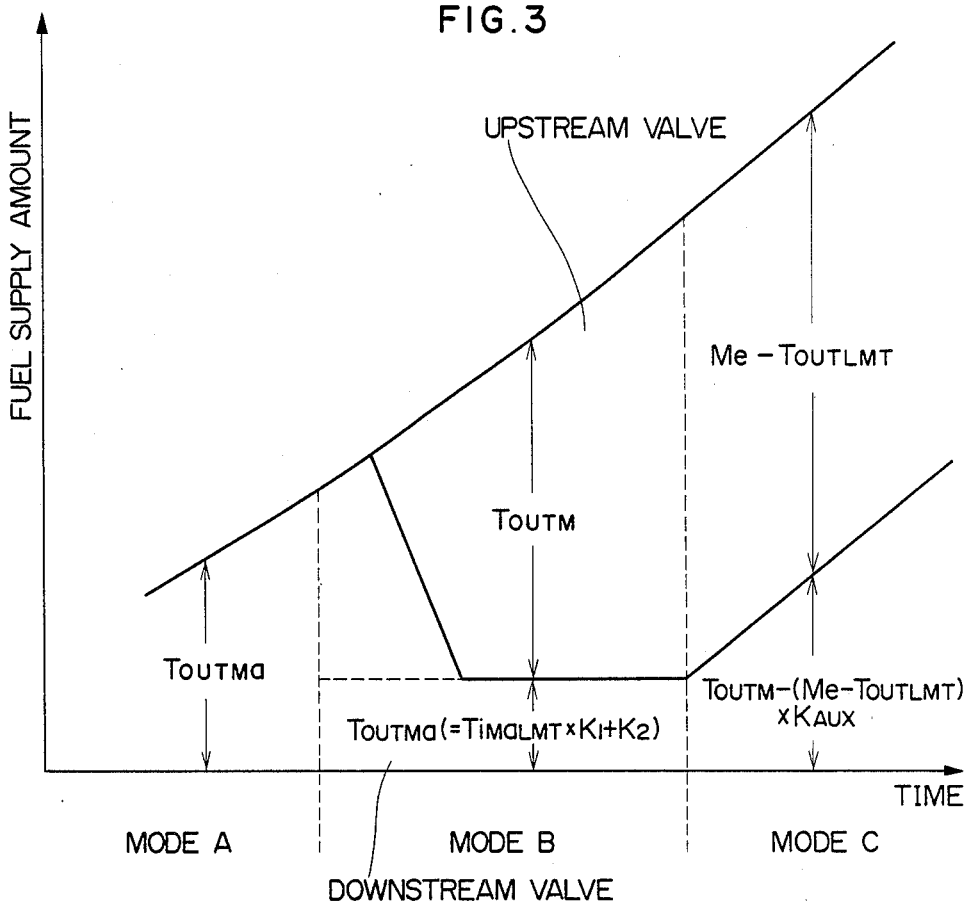
FIG. 3 is a graph showing a variation in the fuel supply quantity with time under control according to the fuel supply control method of the invention.

The fuel supply characteristics of the fuel supply control system controlled by the fuel supply control program of FIG. 2 will be described hereinafter with reference to FIG. 3 showing variations in the respective fuel supply quantities of the upstream valve 6 and the downstream valve 6a with the lapse of time in accelerating the engine operating in the mode A when the temperature $T_W$ of the cooling water is higher than $T_{WMA}$.

When the engine is operating in the mode A, the downstream valve 6a supplies fuel in quantities corresponding to $T_{OUTMa}$ selected from the $P_B$—Ne map. When the operating mode of the engine shifts from the mode A to the mode B, the fuel injection period of the downstream valve 6a is gradually decreased by the decrement of $\Delta T_{OUTMa1}$ or $\Delta T_{OUTMa2}$ to $T_{OUTMaLMT} = T_{iMaLMT} \times K_1 + K_2$. While the fuel injection period of the downstream valve 6a is thus gradually decreased, the fuel injection period of the upstream valve 6 is $T_{OUTM}$ selected from the $P_B$—Ne map. However, the amount of fuel actually supplied to the cylinders by the upstream valve 6 gradually increases from zero to the amount corresponding to $T_{OUTM}$ because part of fuel injected by the upstream valve 6 initially wets inner surfaces of the throttle body 3 and surfaces of the throttle valve 3'. In some cases, a required fuel injection quantity exceeds the maximum fuel injection qruantity of the upstream valve 6 corresponding to the maximum fuel injection period Me—$T_{OUTLMT}$ *when the operating mode of the engine shifts from the mode B to the mode C. In such a case, the downstream valve 6a* injects fuel for a fuel injection period $[T_{OUT}-(Me-T_{OUTLMT})] \times K_{AUX}$ to supplement the required fuel injection quantity.

Although the invention has been described in its preferred form with a certain degree of particularity, many changes and variations are possible therein in the light of the above teachings. It is therefore to be understood that the present invention may be practiced otherwise than specifically described herein without departing from the scope and spirit thereof.

What is claimed is:

1. A method of controlling the supply of fuel to an internal combustion engine having a plurality of cylinders, an intake passage having an intake manifold connected to said cylinders, a throttle valve arranged in said intake passage at a location upstream of said intake manifold, at least one first fuel injection valve arranged in said intake passage at a location upstream of said intake manifold, and at least one second fuel injection valve arranged in said intake passage at a location upstream of said intake manifold and upstream of said first fuel injection valve, wherein said first and second fuel injection valves are selectively operated to supply fuel to said cylinders in dependence on operating conditions of said engine, the method comprising the steps of:

(a) determining whether or not said engine is operating in a predetermined low load condition;

(b) supplying fuel in an amount responsive to said predetermined low load condition to said cylinders through said first fuel injection valve alone, when said engine is determined to be operating in said predetermined low load condition; and (c) supplying fuel to said cylinders through both said first and second fuel injection valves when said engine is determined to be operating in an operating condition other than said predetermined low load condition in a manner such that (1) said second fuel injection valve supplies a first amount of fuel which is required for said operating condition other than said predetermined low load condition and (2) said first fuel injection valve supplies a second amount of fuel which compensates for a portion of said first amount of fuel supplied by said second injection valve which portion is not immediately and directly supplied to said cylinders.

2. A method as claimed in claim 1, wherein said first fuel injection valve is arranged at a location downstream of said throttle valve, and said second fuel injection valve at a location upstream of said throttle valve, respectively.

3. A method as claimed in claim 1, wherein in said step (c) the quantity of fuel supplied by said first fuel injection valve is set to a minimum required value which is substantially constant.

4. A method as claimed in claim 3, wherein said minimum required valve of the quantity of fuel supplied by said first fuel injection valve substantially corresponds to the minimum value that can be accurately metered by said first fuel injection valve.

5. A method as claimed in claim 1, wherein in said step (c), the quantity of fuel supplied by said first fuel injection valve is progressively decreased, for a limited period of time after said engine has shifted from said predetermined low load condition to said operating condition other than said predetermined low load condition, before it is set to a minimum required value which is substantially constant.

6. A method as claimed in claim 5, wherein the rate at which the quantity of fuel supplied by said first fuel injection valve is progressively decreased is determined according to the rotational speed of said engine.

7. A method as claimed in claim 1, including the steps of: determining fuel injection periods of said first and second fuel injection valves on the basis of operating parameters of said engine and in synchronism with a signal generated at predetermined crank angles of said engine when said engine is operating in said operating condition other than said predetermined low load condition, measuring a time interval of generation of said signal, comparing a period of time corresponding to the measured time interval of generation of said signal with the determined fuel injection period of said second fuel injection valve, and when the latter is longer than the former, supplying fuel over a fuel injection period corresponding to a difference between the two periods of time in place of said determined fuel injection period of said first fuel injection valve to said cylinders through said first fuel injection valve and at the same time supplying fuel over the measured time interval of generation of said signal to said cylinders through said second fuel injection valve.

8. A method of controlling the supply of fuel to an internal combustion engine having a plurality of cylinders, an intake passage having an intake manifold connected to said cylinders, a throttle valve arranged in said intake passage at a location upstream of said intake manifold, at least one first fuel injection valve arranged in said intake passage at a location upstream of said intake manifold, and at least one second fuel injection valve arranged in said intake passage at a location upstream of said intake manifold but axially different from the location of said first fuel injection valve, wherein said first and second fuel injection valves are selectively operated to supply fuel to said cylinders in dependence on operating conditions of said engine, the method comprising the steps of:

(a) determining whether or not said engine is operating in a predetermined low load condition;

(b) supplying fuel to said cylinders through said first fuel injection valve alone, when said engine is determined to be operating in said predetermined low load condition;

(c) supplying fuel to said cylinders through both said first and second fuel injection valves, when said engine is determined to be operating in an operating condition other than said predetermined low load condition; and (d) determining fuel injection periods of said first and second fuel injection valves on the basis of operating parameters of said engine and in synchronism with a signal generated at predetermined crank angles of said engine, measuring a time interval of generation of said signal when said engine is operating in said operating condition other than said predetermined low load condition, comparing a period of time corresponding to the measured time interval of generation of said signal with the determined fuel injection period of said second fuel injection valve, and when the latter is longer than the former, supplying a quantity of fuel corresponding to a difference between the two periods of time to said cylinders through said first fuel injection valve and at the same time supplying a quantity of fuel corresponding to the measured time interval of generation of said signal to said cylinders through said second fuel injection valve, wherein said period of time corresponding to the time interval of generation of said signal is a difference between the measured time interval of generation of said signal and a period of time required for said second fuel injection valve to become completely shut from an open state thereof.

9. A method of controlling the supply of fuel to an internal combustion engine having a plurality of cylinders, an intake passage having an intake manifold connected to said cylinders, a throttle valve arranged in said intake passage at a location upstream of said intake manifold, at least one first fuel injection valve arranged in said intake passage at a location upstream of said intake manifold, and at least one second fuel injection valve arranged in said intake passage at a location upstream of said intake manifold but axially different from the location of said first fuel injection valve, wherein said first and second fuel injection valves are selectively operated to supply fuel to said cylinders in dependence on operating conditions of said engine, the method comprising the steps of:

(a) determining whether or not said engine is operating in a predetermined low load condition;

(b) supplying fuel to said cylinders through said first fuel injection valve alone, when said engine is determined to be operating in said predetermined low load condition;

(c) determining fuel injection periods of said first and second fuel injection valves respectively on the basis of operating parameters of said engine and in synchronism with a signal generated at predetermined crank angles of said engine, so that fuel may be supplied to said cylinders through both said first and second fuel injection valves when said engine is determined to be operating in an operating condition other than said predetermined low level condition;

(d) measuring a time interval of generation of said signal;

(e) comparing a period of time corresponding to the measured time interval of generation of said signal with the determined fuel injection period of said second fuel injection valve; and (f) when the latter is longer than the former, supplying a quantity of fuel corresponding to a difference between the two periods of time to said cylinders through said first fuel injection valve and at the same time supplying a quantity of fuel corresponding to the measured time interval of generation of said signal to said cylinders through said second fuel injection valve.

* * * * *